United States Patent [19]

Bernt et al.

[11] 4,244,687

[45] Jan. 13, 1981

[54] CHAIN CONSTRUCTION AND ARRANGEMENT FOR ROTARY KILN-TYPE DEVICES

[75] Inventors: Jorgen O. Bernt, Oakville; Barry C. Forster, Mississauga, both of Canada

[73] Assignee: J. O. Bernt & Associates Limited, Oakville, Canada

[21] Appl. No.: 34,464

[22] Filed: Apr. 30, 1979

[51] Int. Cl.[3] ..... F27B 7/14

[52] U.S. Cl. ..... 432/118; 34/142; 59/84; 159/9 R

[58] Field of Search ..... 432/118; 34/142; 159/9 R, 9 A; 59/84

[56] References Cited

U.S. PATENT DOCUMENTS

| | | | |
|---|---|---|---|
| 1,910,873 | 5/1933 | Zahn | 432/118 |
| 3,796,246 | 3/1974 | Walenta | 59/84 |

FOREIGN PATENT DOCUMENTS

| | | | |
|---|---|---|---|
| 635040 | 9/1936 | Fed. Rep. of Germany | 34/142 |
| 330321 | 11/1972 | U.S.S.R. | 432/118 |

*Primary Examiner*—John J. Camby

[57] ABSTRACT

A chain for use with kilns defines links, each with a flat area. The connection between the links is such that the flat areas in adjacent links tends to align with each other in the hanging attitude of the chain whereby the chain may be hung with the flat areas facing axial flow of materials in the kiln and acting as an impediment thereto. Arrays of such chains are hung from the wall of the kiln to collectively impede the flow of gas-borne particulate material.

5 Claims, 9 Drawing Figures

CHAIN CONSTRUCTION AND ARRANGEMENT FOR ROTARY KILN-TYPE DEVICES

Figure 1:
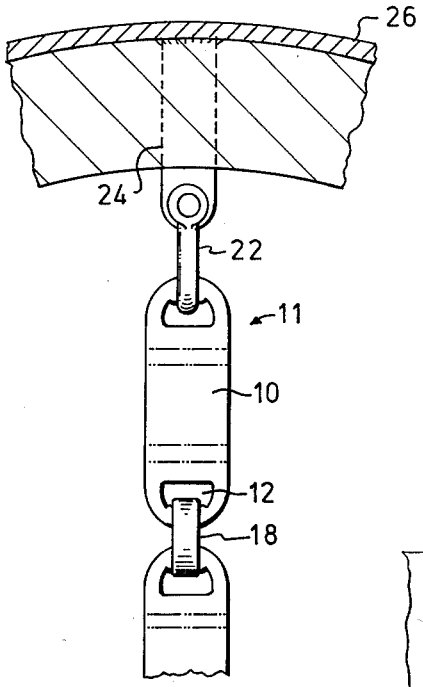

This invention relates to a chain and to an arrangement of chains for use in rotary kiln-type devices having rotatable walled passages wherein there is gas borne particulate material.

Examples of such rotary kiln-type devices rotatable walled passages include: rotating kilns, drum driers, calciners, roasters, mixers and the like of the type which are used in: making cement, the processing of minerals, mining, the production of lime and in other industries. The term rotary kiln-type device is thus used herein as a generic term for all such devices. In those of such devices with which the invention is concerned the device rotates with a bed of particulate material therein and heated gases, usually for heating and or for promoting a reaction in the particulate material, travel over the bed in the opposite direction to the general intended flow direction of the particulate material through the kiln-type device. Frequently such rotary kiln-type device is provided with means for raising the particulate material into the gas stream which increases the amount thereof which is gas borne.

In such an environment a substantial proportion of the particulate material in the kiln-type device becomes suspended in and carried by the heated gases. If such suspended material escapes from the kiln-type device in the counter flow direction it causes a loss of the particulate material and of heat. In some instances, under present practices, part of the escaped particulate material is recaptured in suitable external dust collection equipment and returned to the kiln. However the recapture of the escaped dust requires a substantial investment in dust collection equipment and in material handling eqipment, which is required to permit return of the dust to the kiln-type device. Moreover, such dust recapture and return procedures tend to resemble batch type processes, whereas the operation in a kiln type device is usually a continuous process. The superposition of a batch type operation on the continuous process tends to introduce dis-continuities in the thermal or chemical operations in the continuous process.

In other cases, the dust is removed from the gases in separate equipment to meet environmental criteria. Such separate equipment may involve the use of wet scrubbers or similar equipment to minimize environmental pollution. Such devices of course involve additional expense, maintenance and space.

It is an object of the invention to provide a chain which may be suspended from the inside wall of a rotary kiln type device and which will be effective to interfere with the path of gas-borne particulate material and to cause particulate material to fall out of the gas stream due to: loss of momentum of the particle; to impact on the chain; deflections of the gas stream; and centrifugal force.

It is an object of the invention to provide a chain which may be suspended from the cylindrical inner wall of the kiln type device, which chain comprises a plurality of wide, relatively flat, links, connected to flex about axes perpendicular to the axis of the chain but further connected to tend to maintain their flat sides directed in the same direction. With the flat sides directed in the same direction, such chain may be suspended with its flat sides facing the direction of gas flow to provide maximum effect in removing particulate material from the gas.

It is an object of the invention to combine an array of such chains suspended at circumferentially spaced points about the inner wall of a kiln type device, whereby a plurality of such chains will hang from the part of the inner wall uppermost at the time, to form a collective impediment, to the flow of particulate matter therepast, and instruments for removing particulate material from the gas stream.

It is a preferred object of the invention to combine an array of chains described in the previous paragraph with at least one other similar array wherein the similar array is displaced axially along the kiln type device from the first array and where the circumferential disposition of the chains of the second array are respectively selected to be located between circumferential locations of chains of said first set, whereby the combined sets form a collective barrier which tends to remove particulate matter from the gases due to such effects as their loss of momentum and to the centrifugal effects thereon.

Figure 2:
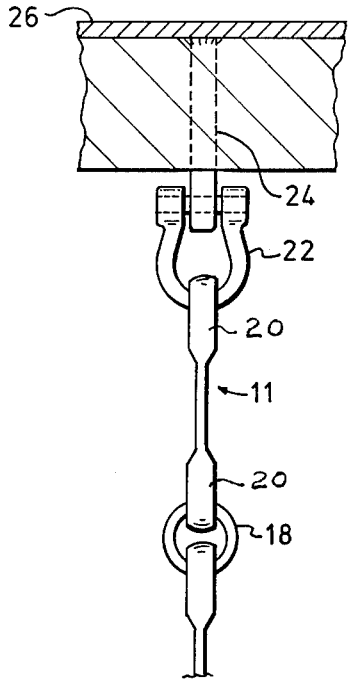
Figure 3:
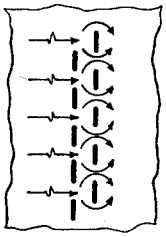
Figure 4:
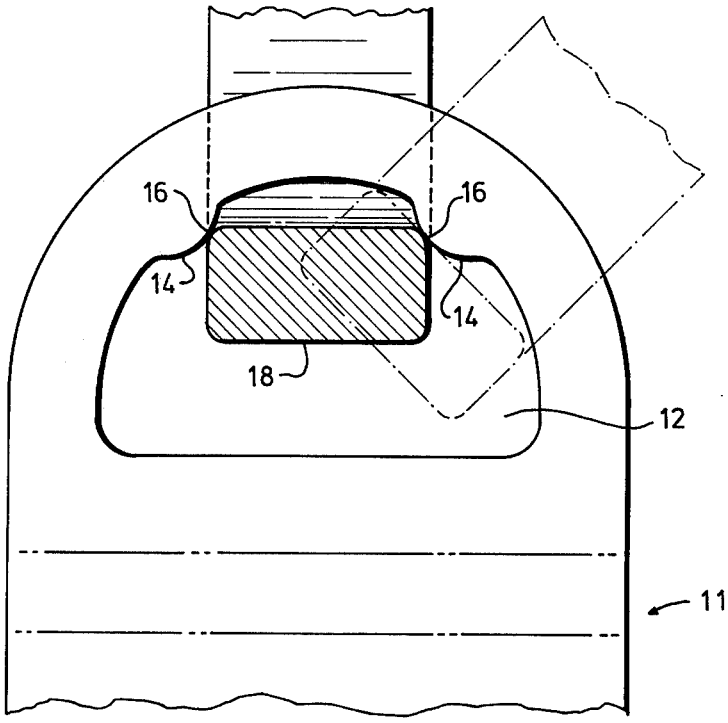
Figure 5:
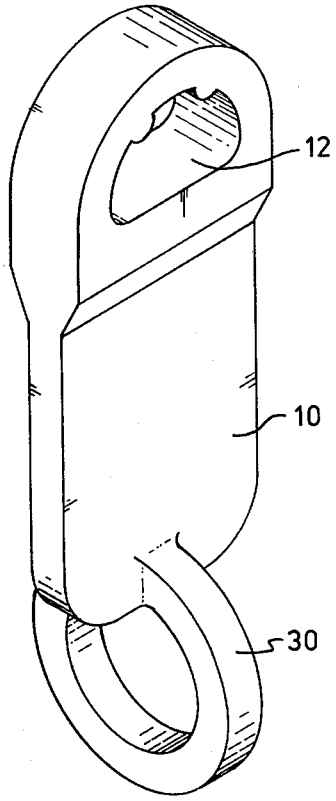
Figure 6:
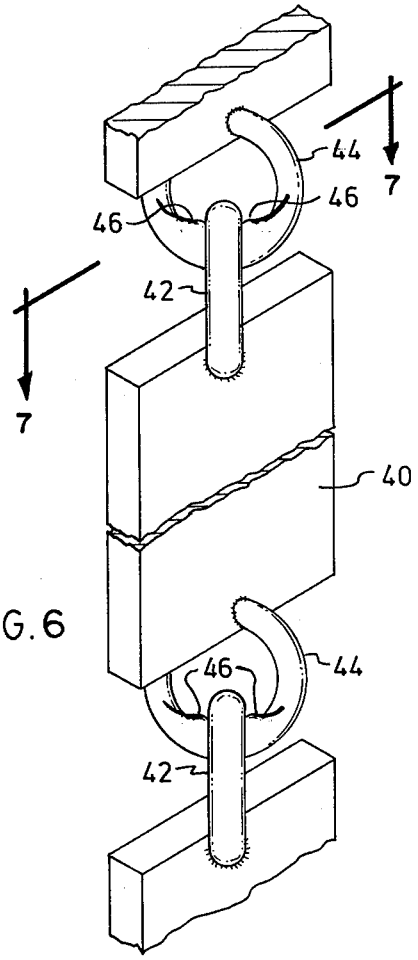
Figure 7:
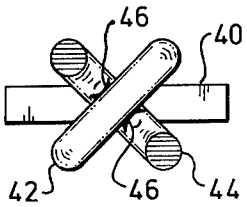
Figure 8:
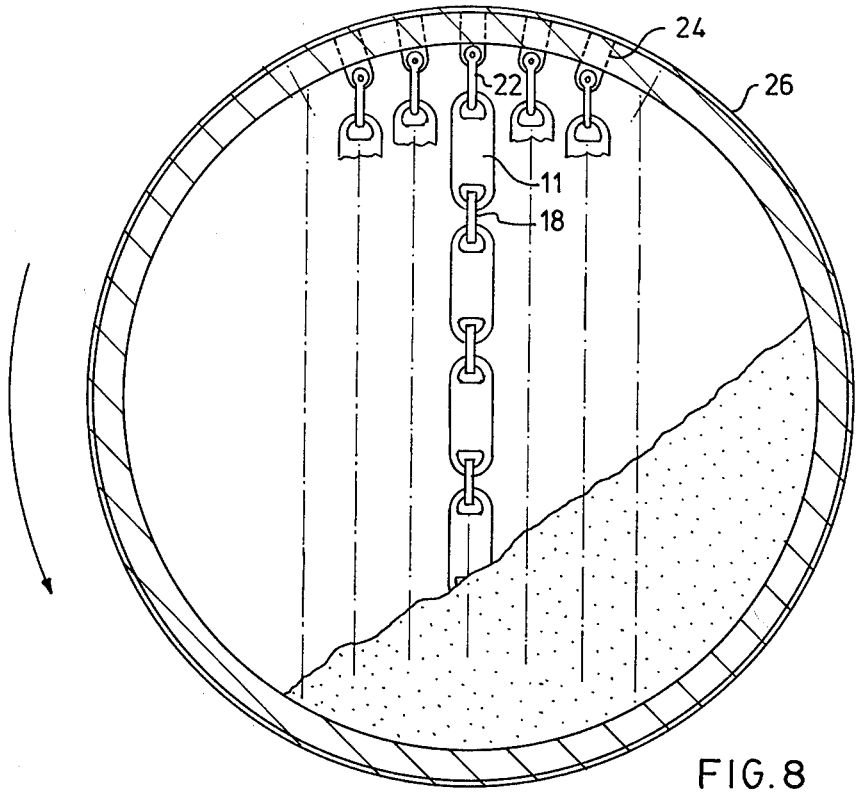

In drawings which show a preferred embodiment of the invention:

FIG. 1 shows a preferred form of chain, in accord with the invention, viewed axially of the kiln, FIG. 2 shows the chain of FIG. 1 viewed horizontally and transverse to the axis of the kiln, FIG. 3 shows the relative arrangement of two arrays of chain suspension points in a flattened view of a kiln wall, FIG. 4 is an enlargement of a portion of FIG. 1 showing the connection of links in the chain, FIG. 5 shows an alternate link to that shown in FIGS. 1–4, FIG. 6 shows a further alternate link and chain to those shown in FIGS. 1–4, FIG. 7 shows a view along the line 7—7 of FIG. 6, and FIG. 8 shows a cross-section of a kiln, wherein there are chains in accord with FIG. 1.

Figure 9:
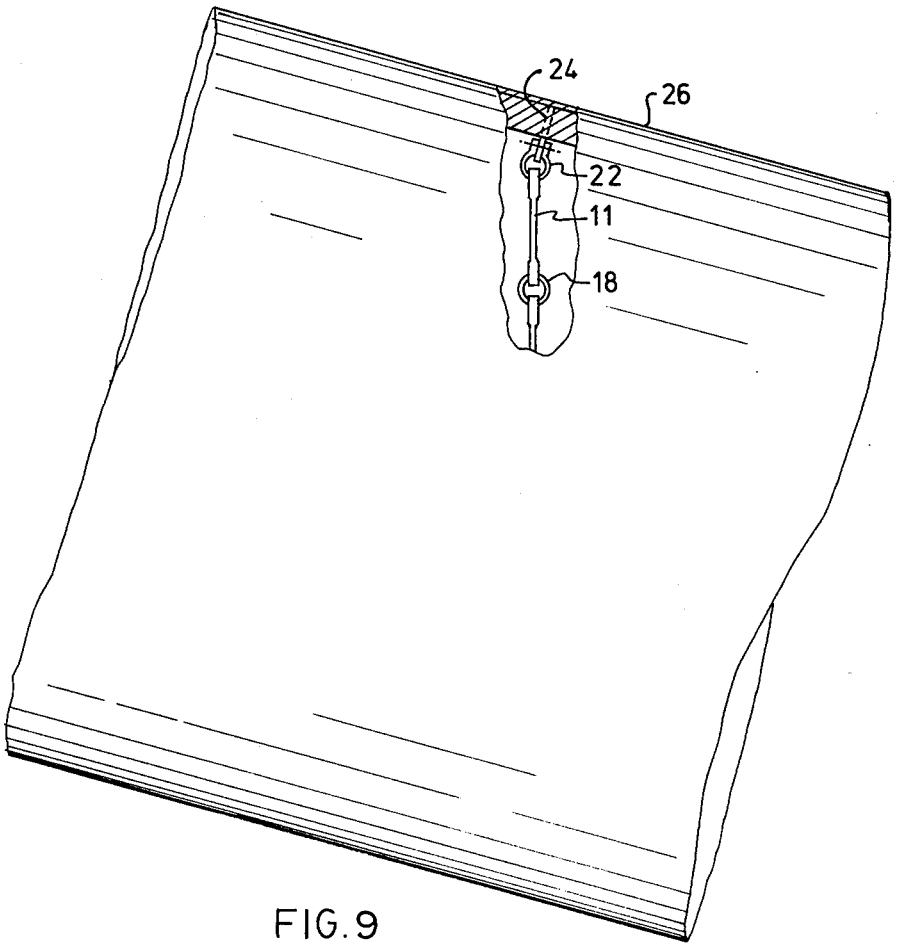

FIG. 9 shows a side view of a kiln in which the invention may be used.

In the drawings, the chain of FIGS. 1, 2 and 4 comprises a link 11 which is a flat plate 10 having wider width and depth dimensions than thickness, and defining at each end generally semi-circular shaped apertures 12, convex toward the end of the link, as best shown in FIG. 4. It will be noted, from FIG. 2, that the thickness of the link, although substantially less than its length or width is preferably larger at the ends than in the central portion of the link. As best shown in FIG. 4, the material defining the semicircular opening is provided with two inwardly directed abutments 14 symmetrically located on each side of the median of the flat side of the link. The portion of the opening between and above the abutments forms a shallow slot for reception of the joining link. It will be noted that the slot, as defined by the abutments 14 and as shown in FIG. 4 preferably has tapering sides 16, tapering inwardly toward the end of the link as defined by the abutment surfaces. It will also be noted that the defining walls of the slot are substantially transverse to the median plane of the flat plate of the link, i.e. the cross section of the aperture is constant through the thickness of the link.

The joining link 18 is preferably a ring, shown in various views of FIGS. 1,2 and 4. It will be seen that a link 18 joins two flat links 11 passing through the upper aperture 12 of one and the lower aperture 12 of the other. As best shown in FIG. 4 the joining link preferably has a generally rectangular cross-section wider than its depth (in the preferred attitude as shown in solid lines in FIG. 4). The width of the cross-section of the joining link is preferably selected so that, when new its upper corners ride on the tapering sides 16 of the flat link. The links 11, and 18 under the gravitational effects on a hanging chain, tend to assume the attitude of FIG. 4, and in inverted relationship the same attitude at the bottom of the link 11. When the chain, under rotary operation of the kiln, begins to wear, the wear on the engaging surfaces of the joining and flat link 11 and 18, causes ring 18 to ride gradually upward into the slot. Because the sides defining the slot are transverse to the median plane of the flat link the joining link tends to maintain its alignment approximately perpendicular to the two flat links it joins, and hence, when the chain is hanging, tends to maintain the flat links aligned, one with the other. The thicker portions 20 at each end of link 11 assist in this result. Thus, as shown, the chain may be joined by a shackle 22 to a metal hanger 24 welded to the metal, outer surface 26 of the kiln, and extending inwardly through the kiln walls. As shown the shackle may be selected in cooperation with the hanger design and the link design to tend to keep a desired alignment, in a hanging chain, between the hanger on the one hand and the top link of the chain on the other hand. Thus the chains, as designed, may be suspended from suspension points (represented by the hangers) to hang with their flat sides aligned and with their faces perpendicular to the axis of the kiln. Obviously this will not be true of chains when they are trailing on the wall of the kiln, or on the bed of material therein or when they are tangled. In the preferred embodiment of the invention, shown in FIGS. 1,2 and 4; and best illustrated in FIG. 4 the depth of the semicircular aperture 12 from the outer end to the centre of the flat side is made sufficiently large to allow the rotation of the joining link 18 therein (the chain dotted orientation of the joining link tends to illustrate this). This freedom of orientation of the joining link 18 in the flat link 11 prevents jamming in the oscillation and flexing of the chain so that, when the suspension point of the chain reaches its uppermost point the chain tends to hang straightly.

It will be noted that the form of the chain in FIGS. 1, 2 and 4 (as well as of the other forms herein) allows flexing of joined links relative to each other about horizontal axes perpendicular to the vertical hanging direction. Thus universal flexure about horizontal axes is allowed between adjacent links of chains in accord with the inventive design. This reduces jamming and tangling of the chain.

FIG. 3 shows a horizontal development of the inner wall of a cylindrical kiln showing an arrangement of two arrays of chains each arranged in a row to provide an impact barrier to gas-borne material in the kiln. As FIG. 3 shows, the chains in the second ring are offset to interfere with the path of particulars flying between the links of the first row of chains. FIGS. 8 and 9 are provided to show the location of such rings of chains in a rotating kiln. As illustrated in FIG. 9 the rotary kiln slopes from an inlet toward an outlet end. Counterflowing gases pass through the kiln in the opposite direction carrying particulate matter which it is desired to remove from the stream by impact on the chains. FIG. 9 shows the appearance of the chains looking axially along the kiln. Only a few of the central chains are shown but it will be understood that, as indicated in FIG. 3, the chains are regularly spaced about the circumference and those which at a time are on downwardly facing walls hang downward to form a curtain or curtains across the kiln. As noted in the introduction, the chains may be used in such devices as: rotating kilns, drum driers, calciners, roasters, mixers and the links of the type which are used in making cement, the processing of minerals, mining, the production of lime and in other industries. The term rotary kiln-type device is used herein as a term inclusive of these applications.

In order to provide impact areas which will tend to interfere with a large proportion of the gas borne particles, preferably at least two rings of such chains are provided with their flat sides facing in the axial direction. Where two rings are used the chains of the second row should be stepped half an interval circumferentially relative to the first so that the chains of the second ring are directly located in the path of particles passing between chains of the first row. Such arrangement is best shown by the development of FIG. 3. With such an arrangement the chains in a ring are preferably spaced apart (i.e. the minimum space between them is) less than the width of a flat link. The axial spacing between rings should not be larger than 10 times the width of a link 11 and should preferably be less than 5 times the width of a link 11. By way of comparison, it will be noted that the vertical dashes represent the width of flat links and thus the axial spacing shown in FIG. 3 is just over one flat link width.

The fact that two rings of chains are used does not alter the fact that a single ring spaced as above stated, is considered within the scope of the invention and that rings singly or in pairs may not be spaced or cascaded at spacings of over 10 widths. However, when the spacing of two rings or pairs of rings is greater than 10 flat link widths, each ring or pair tends to act independently of the other. The above discussion and the alternatives discussed, do not exclude the use of three or more rings closely axially spaced where the use of 3 or more rings of chains allows somewhat wider spacing in a single ring.

FIG. 5 shows an alternate way of forming a flat link from that shown in FIGS. 1, 2 and 4. The link of FIG. 5 is, over its flat body and in material defining the aperture at one end, identical to that of FIGS. 1, 2 and 4. However at the other end a loop 30 is provided with its axis transverse to the material forming the aperture 12. The cross section of the material forming the loop is sloped to fit partially into the slot between the abutments 14 extending into the aperture so that the 'fit' of the loop into the aperture is the same as that shown in FIG. 4.

Thus although requiring a more complex link (that of FIG. 5), the joining link 18 is eliminated and a chain may be formed of the links of FIG. 5 which will resist misalignment of the flat links and tend to hang with the flat areas of the links aligned. Thus the chain is easily suspended with its flat areas facing the rotary axis of the kiln type device. Conversely the link connection of the links of FIG. 5 allows universal connection of the links of the chain in its contortion with minimized tendency to tangle.

FIGS. 6 and 7 show a further alternative form of chain where a flat plate 40 is provided with upper and lower loops at 90° to each other measured about the axis of a hanging chain made of such links. One of the upper or lower loops (here the lower, 44) of each chain is provided with abutments 46 tending to make the loops tend to remain mutually perpendicular, to retain the flat sides of the plates 40 aligned, to be suspended with the flat sides facing axially and to allow universal movement between the links.

With respect to all the chains described herein these may all be made by casting techniques, well known to those skilled in the art, which allows the casting (sometimes in two stages) of chains with the links already interconnected. On the other hand chains may be made in accord with the invention by casting the main body of links separately and thereafter providing the connection by welding the connection link, or loop.

I claim:

1. Chain for use in rotating, walled, passages containing gas-borne particulate material, said chain comprising:

a plurality of flat area links having, in their designed orientation on said chain, a flat material of greater width and depth dimensions than thickness dimension;

a loop at each end of said flat material, defining an aperture between said loop and said flat material, connecting connector links joining a loop of one link to a loop of the next, whereby said flat area links and said loops define an extended, substantially straight, hanging attitude for said chain when said chain is suspended from one end;

said flat material being arranged so that said width and depth dimensions are located in a substantially vertical plane in the extended, substantially straight, hanging attitude of said chain, said loops being provided with means defining a shallow slot to, at least partially, receive said link in the extended, substantially straight hanging attitude of said chain, and to determine, in such attitude, the orientation of a link so received, relative to the loop about the axis of the chain in said attitude, said loops and the orientation of said shallow slot being arranged so that said flat material in said flat area links is aligned, said loops being shaped so that said apertures are large enough to allow the removal of said links from said shallow slots during flexure of the chain, said links and apertures being designed and constructed to allow universal movement of adjacent links relative to one another, during flexure of said chain, about directions perpendicular to the axis of said chain.

2. In a rotary kiln type device having a cylindrical walled passage for particulate material, rotatable about the axis of said cylinder, through which travel gases having particulate material suspended therein in a predetermined direction, an array of chains as defined in claim 1, suspended to hang from the inner wall of said housing, said array comprising a set of chains suspended at one end only from suspension points on the inner wall of said container, said suspension points being spaced circumferentially from each other, and the array extending about said inner wall.

3. Chain for use in rotating, walled, passages containing gas-borne particulate material, said chain comprising:

a plurality of flat area links having, in their desired orientation on said chain, a flat material of greater width and depth than thickness, a loop at each end of said flat material, defining an aperture between said loop and said flat material, the loop at one end of said flat material of one link being designed to connect with the loop at the other end of said flat material of the next link, whereby said flat area links and said loops define an extended, substantially straight, hanging attitude for said chain when said chain is suspended from one end, said flat material being arranged so that said width and depth dimensions are located in a substantially vertical plane in the extended, substantially straight, hanging attitude of said chain, one of said loops being provided with means defining a shallow slot, to at least partially, receive said link in the extended, substantially straight hanging attitude of said chain, and to determine, in such attitude, the orientation of a link so received, relative to the loop, about the axis of the chain in said attitude, said loops and the orientation of said shallow slot being arranged so that said flat material in said flat area links is aligned, said loops being shaped so that said apertures are large enough to allow the removal of said links from said shallow slots during flexure of the chain, said loops and apertures being designed and constructed to allow universal movement of adjacent links relative to one another, during flexure of said chain, about directions perpendicular to the axis of said chain.

4. In a rotary kiln type device having a cylindrical walled passage for particulate material rotatable about the axis of said cylinder, through which travel gases having particulate material suspended therein in a predetermined direction, an array of chains as defined in claim 3, suspended to hang from the inner wall of said housing, said array comprising a set of chains suspended at one end only from suspension points on the inner wall of said container, said suspension points being spaced circumferentially from each other, said array of spaced suspension points extending about said inner wall.

5. In a device as claimed in claim 2 or 4 including at least a second array of chains axially displaced along said housing from said first mentioned array, wherein suspension points in said further plurality are located, circumferentially, between suspension points of said first mentioned array.

* * * * *